United States Patent [19]

Le Brocq

[11] Patent Number: 4,909,178

[45] Date of Patent: Mar. 20, 1990

[54] AUTOMOBILE ROUTE INDICATOR

[76] Inventor: Walter Le Brocq, 13072 B. Allard Ave., Garden Grove, Calif. 92604

[21] Appl. No.: 173,178

[22] Filed: Mar. 24, 1988

[51] Int. Cl.[4] ..... G09F 11/02

[52] U.S. Cl. ..... 116/28 R; 40/593; 40/643; 40/660; 116/309; 116/310; 248/205.6

[58] Field of Search ..... 116/29, 299, 317, 337, 116/308–311, 28 R; 40/377, 502, 503, 506, 593, 594, 597, 600, 643, 660, 661, 575; 235/117 A, 118; 248/206.5

[56] References Cited

U.S. PATENT DOCUMENTS

| | | | |
|---|---|---|---|
| 1,445,202 | 2/1923 | Colby | 40/385 |
| 1,508,523 | 9/1924 | Naterman | 40/660 |
| 1,856,519 | 5/1932 | Spears | 40/593 |
| 1,909,708 | 5/1933 | Neuwirth | 40/660 |
| 2,619,750 | 12/1952 | Niessen | 116/299 |
| 3,382,594 | 5/1968 | Volger | 40/377 |
| 3,460,508 | 8/1969 | Baxter | 116/317 |
| 3,766,882 | 10/1973 | Babbitt, III | 116/308 |
| 4,182,059 | 1/1980 | Greene | 40/377 |
| 4,558,527 | 12/1985 | Schroedel et al. | 40/343 |

*Primary Examiner*—William A. Cuchlinski, Jr.
*Assistant Examiner*—W. Morris Worth
*Attorney, Agent, or Firm*—William L. Chapin

[57] ABSTRACT

A route indicator for use in automobiles and other motor vehicles uses a route instruction card of a flexible material maintained in a coaxial position within a transparent hollow cylinder by hoop tension produced by the natural elasticity of the card. One end of the cylinder is fastenable by an interference fit to a cup-shaped cap rotatably fastened to the upright portion of a bracket fastenable to a structural member within the vehicle. The cylinder is readily removable from the cap to permit replacement of an instruction card through an open end of the transparent cylinder.

6 Claims, 2 Drawing Sheets

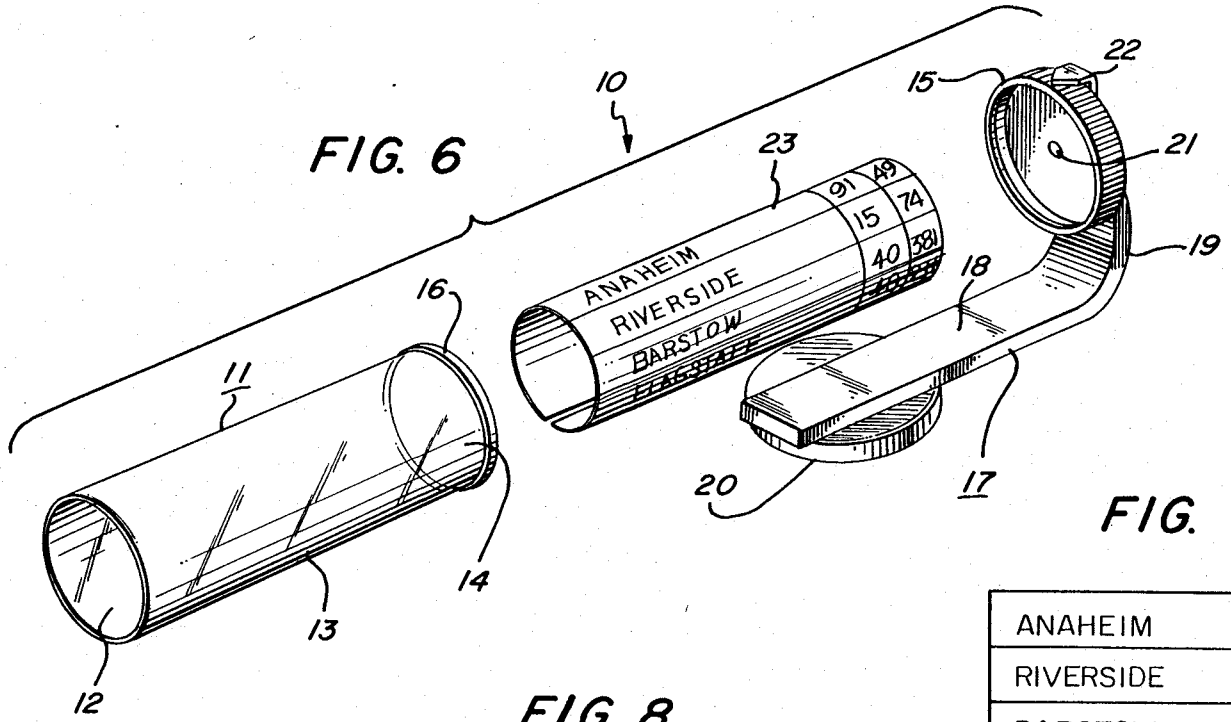
FIG. 6
| ANAHEIM | 91 | 49 |
|---|---|---|
| RIVERSIDE | 15 | 74 |
| BARSTOW | 40 | 381 |
| FLAGSTAFF | 40 | 223 |
| ALBUQUERQUE | 25 | 228 |
| RATON | 25 | 110 |
| PUEBLO | 25 | 37 |
| COLORADO SPRINGS | 25 to 85 | 60 |
| ENGLEWOOD | | |
23
FIG. 7
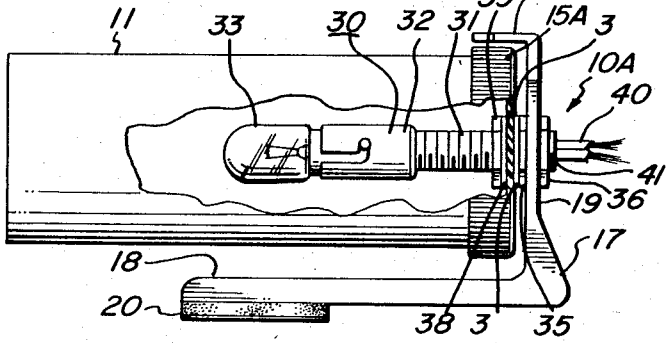
FIG. 8

AUTOMOBILE ROUTE INDICATOR

BACKGROUND OF THE INVENTION

1. Field of the Invention

This invention relates to devices for providing route information to drivers of motor vehicles. More particularly, the invention relates to an article which may be attached to the interior of a vehicle and provide visual route information to the driver.

2. Description of Background Art

The high average speeds and/or heavy traffic on our nation's roads demand the undivided attention of the motorist, to minimize the possibility of being involved in an accident. Also, motorists frequently travel to new destinations over unfamiliar routes, for business or non-business purposes. A map is often used to provide the required route information. However, the large amount of extraneous information on a map, combined with its frequently cumbersome size, make its use by the driver of a moving vehicle generally unsafe.

Various alternatives to the use of a map for providing route information have been proposed. Typically, such prior art devices include means for attachment to a vehicle in a position viewable by the driver, and employ a data sheet containing route information. One class of prior art devices uses a data sheet in the form of a scroll advancable from one member to another within a housing. Typical of these devices are those disclosed in the following U.S. Patents: Cook, U.S. Pat. No. 1,710,207, Apr. 23, 1929, Directory for Drivers, Cook, U.S. Pat. No. 1,844,542, Feb. 9, 1932, Directory for Drivers, and Dull, U.S. Pat. No. 2,021,934, Nov. 26, 1935, Highway Director.

Another class of route guides for motor vehicles uses a data sheet which fastens to the outer cylindrical surface of a roller contained within a larger diameter, cylindrical housing. One such device is disclosed in Guess, U.S. Pat. No. 2,828,563, Apr. 1, 1958, Rotary Data Log. A device for providing data to shoppers is disclosed in Couch, U.S. Pat. No. 4,021,953, May 10, 1977, Shopping Cart Display Guide Selector.

The present invention was conceived of in response to a perceived need for an alternative device to provide route information to the driver of a motor vehicle.

OBJECTS OF THE INVENTION

An object of the present invention is to provide a means for displaying route information to the driver of a motor vehicle.

Another object of the invention is to provide an automobile route indicator which uses data cards which are quickly and easily replaceable.

Another object of the invention is to provide an automobile route indicator which is readily attachable to the structure of an automobile.

Another object of the invention is to provide an automobile route indicator which contains a minimum number of parts and is easy and inexpensive to manufacture.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to specific details of the embodiment described. I do intend that equivalents, adaptations and modifications which may be reasonably construed to employ the novel concepts of the invention described herein be included within the scope of the invention as defined by the appended claims.

SUMMARY OF THE INVENTION

Briefly stated the present invention comprehends a novel route indicator for use in motor vehicles. The novel route indicator according to the present invention includes a transparent, hollow plastic cylinder attached to a bracket by means permitting rotation of the cylinder about its longitudinal axis relative to the bracket. Means are provided to attach the bracket to the dashboard or other interior structure of a motor vehicle, within view of the driver's seat. The cylinder is readily detachable from the bracket, permitting cards containing route instructions to be easily inserted or replaced in the interior of the cylinder. The route instruction card is made of a flexible cardboard or similar material, and has a width slightly less than that of the cylinder. Typically, the card has a length equal to or less than the inner circumference of the cylinder The instruction card is rolled into the form of a tube and inserted into an open end of the transparent cylinder. Radially outward directed hoop tension produced by the natural elasticity of the card maintains the card in proper position within the cylinder for viewing data on the card through the transparent wall of the cylinder.

BRIEF DESCRIPTION OF THE DRAWINGS

FIG. 6 is a fragmentary, exploded perspective view of the article of FIG. 1.

FIG. 7 is a plan view of a route card shown as part of FIG. 6.

FIG. 8 is a partially sectional front elevation view of an alternate embodiment of the article shown in FIGS. 1 through 7.

DETAILED DESCRIPTION OF THE INVENTION

Referring now to FIGS. 1–7, a novel route indicator for use in automobiles and other motor vehicles is shown.

Figure 1:
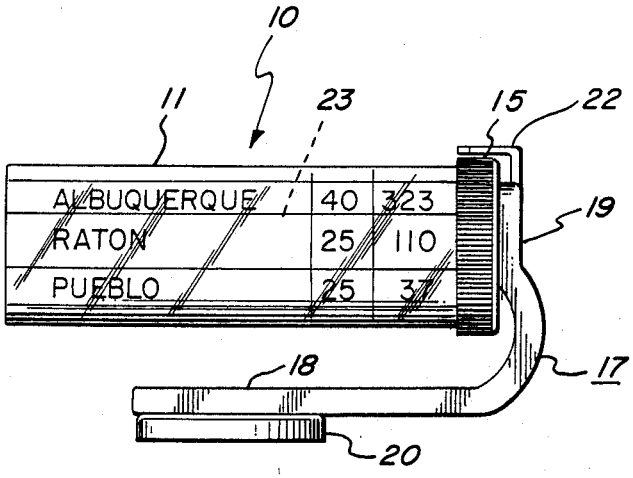
FIG. 1 is a front elevation view of a novel route indicator according to the present invention.

As shown in FIG. 1, the novel route indicator 10 according to the present invention includes a hollow transparent cylinder 11 having a disc-shaped base 12, cylindrical side walls 13, and an open end 14 opposite the end comprised by the base. As may be seen best by referring to FIG. 6, the route indicator 10 includes a concave, cup-shaped cap 15. Means are provided for holding cap 15 in a snap fit over the open end 14 of the cylinder 11. One such means, shown in FIG. 6, includes a radially outwardly projecting annular bead 16 encircling the open end 14 of the cylinder. The cap 15 has a slightly smaller inner diameter than the outer diameter of the annular bead 16 of the cylinder 11, causing the cap and cylinder to be held together in an interference fit when the cap is snapped over the open end of the cylinder.

Referring again to FIG. 1, route indicator 10 is seen to include a bracket 17. The bracket 17 includes a base section 18, and an upright section 19 which extends perpendicularly upwards from one end of the base section. Bracket 17 also includes a fastener or mounting section 20 attached to the lower surface of the base section. The function of the mounting section 20 will be described below.

Figure 2:
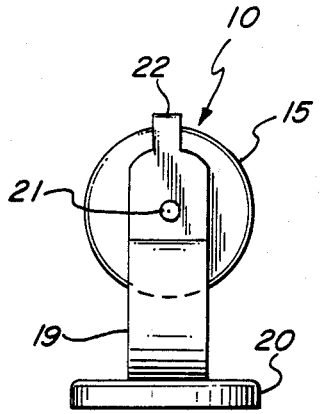
FIG. 2 is a right end elevation view of the article of FIG. 1.
Figure 4:
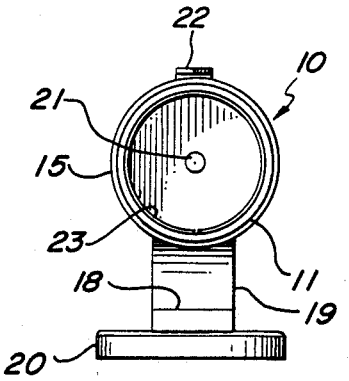
FIG. 4 is a left end elevation view of the article of FIG. 1.

As may be seen best by referring to FIGS. 2 and 4, cap 15 is rotatably mounted to upright section 19 of bracket 17.

As shown in those Figures, a pin 21 extending perpendicularly inwards from an inner vertical face of upright section 19 rotatably supports cap 15 with its longitudinal axis parallel to the base section 18 of bracket 17. Thus, when cylinder 11 is held by cap 15, both cap and cylinder are free to rotate about their common longitudinal axis, which is parallel to the base section 18 of bracket 17.

Figure 5:
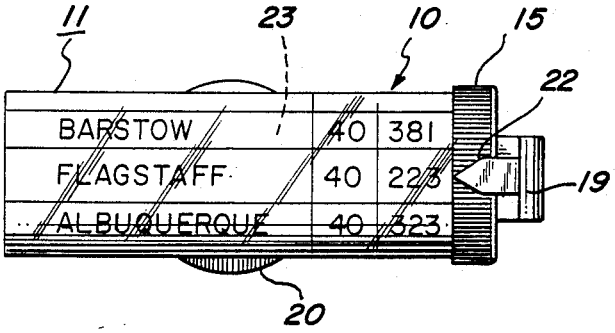
FIG. 5 is a top plan view of the article of FIG. 1.

As may be seen best by referring to FIG. 5, the upright section 19 of bracket 17 may include an index pointer 22 in the shape of a triangular-shaped nib extending axially inwards from the upright section, with its vertex lying over the cylindrical wall 13 of the cylinder, in parallel alignment therewith.

FIG. 7 illustrates a route card 23 used in route indicator 10, and containing an example of route instructions. Route card 23 is fabricated from a thin sheet of flexible material such as thin cardboard, and preferably contains a matrix of preprinted horizontal lines and intersecting vertical lines defining a plurality of rows and columns. In the example route card 23 shown, the entry in column 1, row 1 indicates the departure location, and each successive row in column 1 indicates a destination location. The second column indicates the route or street to be taken between the departure location in the same row, and the destination location in the next lower row. The third column indicates the distance between the departure location in the same row, and the destination location in the next lower row. A fourth column can be included indicating the direction to be taken on a given route, East on 91, for example. For city driving, a fourth column could be used to indicate which direction to turn, thus, for example:

(Departure Location) Elm Street, 2 Mi. left Service station, Oak Avenue, 3 Mi. right side (Destination Location).

Once the appropriate information has been entered onto a route card 23, the card is rolled into the shape of a cylinder, and inserted into the open end 14 of transparent cylinder 11, as may be best visualized by referring to FIG. 6. The natural elasticity of the cardboard or plastic of which the route indicator card 23 is made produces a negative hoop tension tending to unroll the card. This negative hoop tension provides an effective means for holding the card in a fixed position within the cylinder 11, the outer surface of the card pressing against the inner surface of the cylinder. With a route indicator card 23 thus secured within cylinder 11, the cylinder may be inserted into the open end of cap 16, being retained in that position by the interference fit between cap and cylinder.

Figure 3:
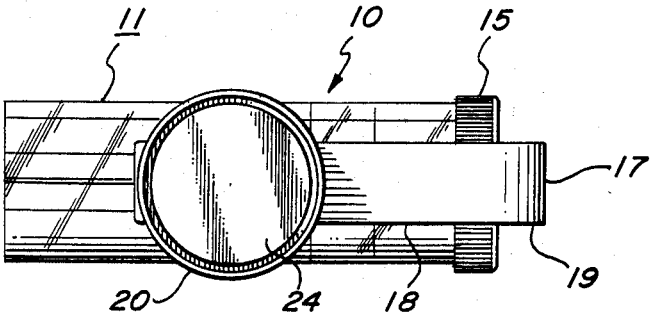
FIG. 3 is a bottom plan view of the article of FIG. 1.

As may be seen best by referring to FIGS. 1 and 3, the route indicator 10 includes a mounting section 20 attached to the lower surface of the base section 18 of bracket 17.

Mounting section 20 contains means for attaching bracket 17 to a structural member inside a motor vehicle, in a position in which the route indicator card 23 inside of transparent cylinder 11 is readily viewable by the driver of the motor vehicle. As shown in FIGS. 1 through 3, mounting section 20 has the shape of a shallow inverted cup. A disc-shaped permanent magnet 24 is fastened to the disc-shaped base 25 of the cup. The permanent magnet 24 provides an attractive force sufficient to hold the route indicator 10 fixed to a ferromagnetic surface of the motor vehicle interior. Alternate means for fastening the mounting section 21 of the route indicator 10 to the interior of a motor vehicle include a suction cup, adhesive strip, or hook and eye "VELCRO" fasteners.

A modification of the route indicator 10 described above is illustrated in FIG. 8. The modified route indicator 10A shown in FIG. 8 includes an internal illumination source 30.

The illumination source 30 includes an elongated, hollow externally threaded tube 31 having a socket 32 and light bulb 33 mounted at one end of the tube in coaxial alignment therewith. The other end of the tube passes through a central hole 34 through end cap 15A, and through a hole 35 through the thickness dimension of upright section 19 of bracket 17. Tube 31 is secured to the upright section 19 of bracket 17 by means of nuts 35 and 36 screwed down on the inner portion of the threaded tube towards the inner surface of the upright section, and an outer portion of the threaded tube towards the outer surface of the upright section, respectively.

An outer bearing washer 37 on the face of nut 35 rotatably supports the outer end surface of cap 15A. An inner bearing washer 38 on threaded tube 31 rotatably supports the inner surface of cap 15A, and is secured in place by an inner nut 39.

Electrical power is supplied to socket 32 and hence to light bulb 33 by means of a two-conductor electrical cable 40 connected at one end to the socket. The cable 40 extends out through the central bore 41 of the hollow threaded tube 31 to an external source of electrical power, such as available at the cigarette lighter of a car or truck.

Modified route indicator 10A provides a very convenient means for providing route information in a darkened vehicle at night, in addition to its daytime capability. To be illuminated by illumination source 30 within route indicator 10 sufficiently well to be conveniently viewed, route card 23 must be reasonably translucent. I have found that polyester drafting film or vellum drafting paper have both the required translucency and ease of writing on to provide entirely satisfactory materials for route card 23.

What is claimed is:

1. A route indicator for motor vehicles comprising;

a. a hollow cylinder having an open end and a closed end and at least partially transparent side walls, said cylinder being adapted to removably hold a selected route instruction card, b. a single cantilevered bracket having a base section adapted to fasten to a structure, and an upright member, and c. a cup-shaped cap member rotatably fastened to said upright member of said bracket and adapted to removably support said open end of said cylinder at one transverse end of said cylinder for rotation in unison of said cylinder and said cup-shaped cap member about the longitudinal axis of said cylinder relative to said upright member of said bracket, whereby said cylinder may be rotated to bring a desired portion of said route information into the field of vision of a user of said route indicator, and whereby said cylinder can be withdrawn from said cap member, said card replaced, and said cylinder re-fastened to said cap member, all with one hand.

2. The route indicator of claim 1 wherein said route instruction card comprises a flexible rectangular card of sufficient elasticity to remain in a fixed position relative to the interior surface of said cylinder when said card is rolled into a generally cylindrical shape and inserted into said cylinder.

3. The route indicator of claim 1 further including an index pointer fastened in a fixed position relative to said bracket, said index pointer lying over the outer cylindrical wall surface of said cylinder in parallel alignment therewith, whereby a desired portion of said instruction card bearing route instructions may be rotated into alignment with said index pointer.

4. The article of claim 1 wherein said open end of said hollow cylinder is adapted to be held within said cap by an interference fit.

5. The article of claim 4 wherein said open end of said hollow cylinder contains on its outer surface an annular ridge adapted to snappingly engage the interior surface of said cap.

6. The article of claim 4 further including an illumination source within said cylinder.

* * * * *